United States Patent [19]

Jennings

[11] Patent Number: 4,635,752

[45] Date of Patent: Jan. 13, 1987

[54] UNIVERSAL MUFFLER CONSTRUCTION ASSEMBLY

[76] Inventor: Freddie L. Jennings, Rte. 4, Box 95, El Dorado, Ark. 71730

[21] Appl. No.: 823,846

[22] Filed: Jan. 29, 1986

[51] Int. Cl.[4] ..... F01N 7/18

[52] U.S. Cl. ..... 181/241; 181/243; 181/265; 181/282

[58] Field of Search ..... 181/241, 243, 265, 266, 181/282

[56] References Cited

U.S. PATENT DOCUMENTS

| | | | |
|---|---|---|---|
| 2,382,159 | 8/1945 | Klemm | 181/241 |
| 3,042,138 | 7/1962 | Reinert | 181/241 |
| 3,145,800 | 8/1964 | Marx | 181/241 |
| 3,386,529 | 6/1968 | Pannone | 181/243 |
| 3,545,566 | 12/1970 | Abrahamsson | 181/241 |
| 4,473,171 | 9/1984 | Clegg et al. | 181/243 |
| 4,516,659 | 5/1985 | Hall et al. | 181/243 |

*Primary Examiner*—Benjamin R. Fuller
*Attorney, Agent, or Firm*—Henderson & Sturm

[57] ABSTRACT

A universal muffler construction (10) comprising: a muffler housing member (11), housing end plate members (12), a primary exhaust tube array (13), a baffle locator plate element (15), an auxiliary exhaust tubing array (16), and, auxiliary end plate elements (17) which are orientable with respect to one another to produce a variety of different internal muffler flow path configurations.

6 Claims, 14 Drawing Figures

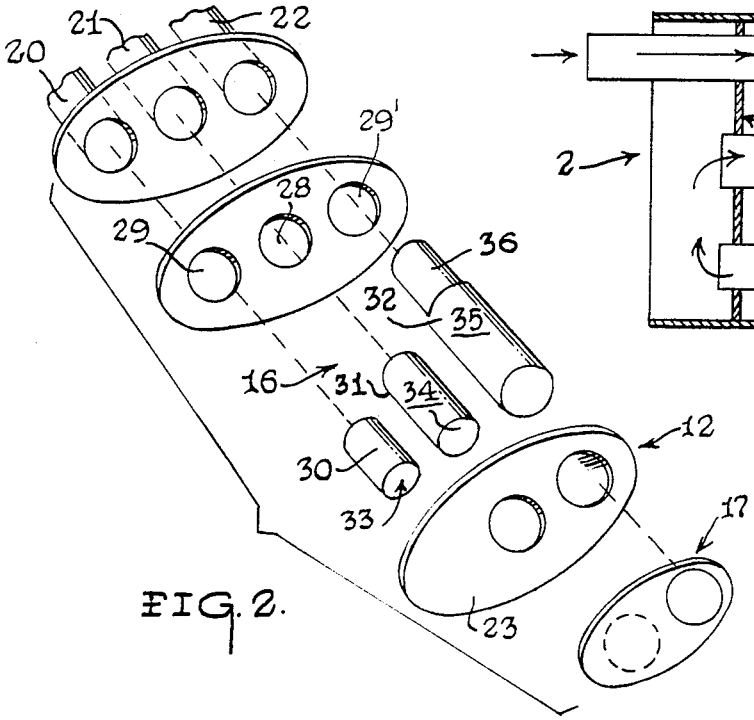
FIG. 2.
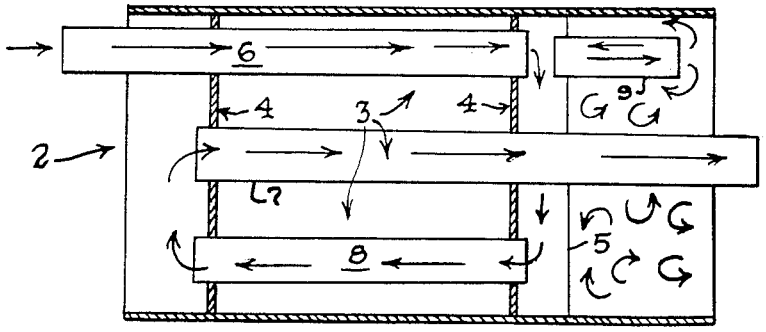
FIG. 1.
(PRIOR ART)
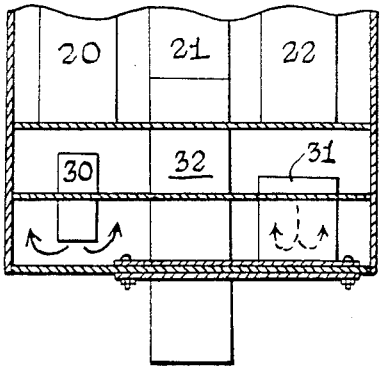
FIG. 3.
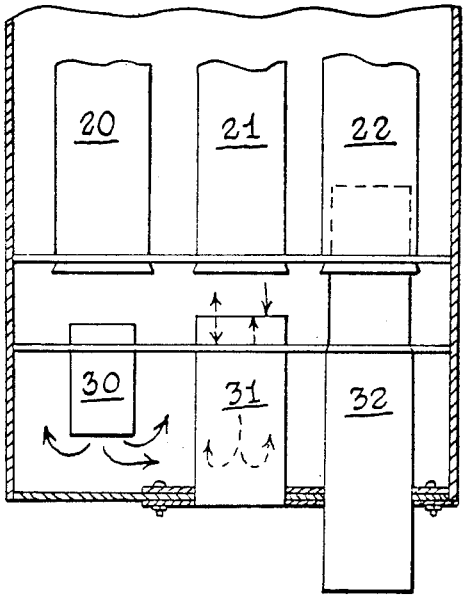
FIG. 4.
FIG. 5.
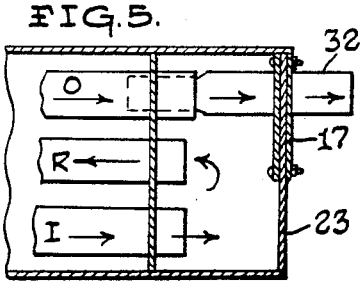
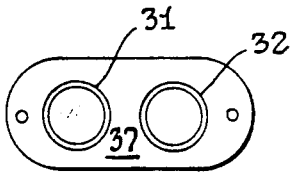
FIG. 8.
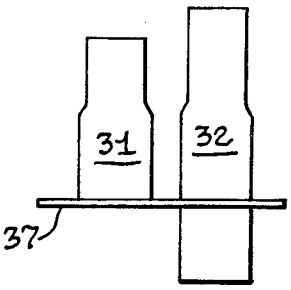
FIG. 9.
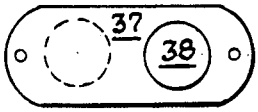
FIG. 6.
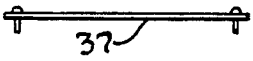
FIG. 7.

FIG. 12.
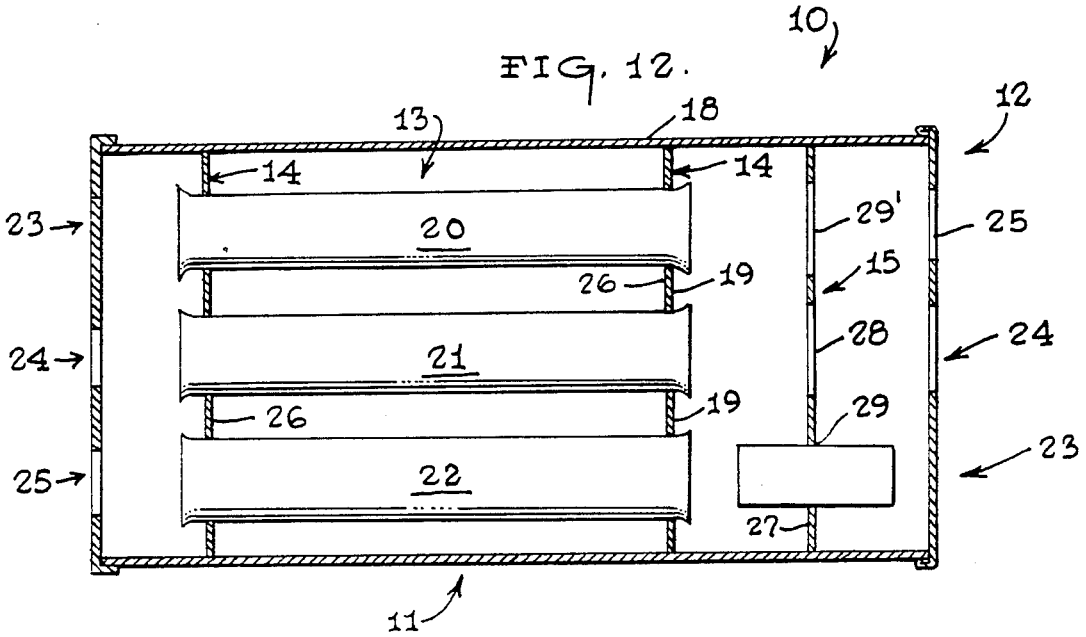
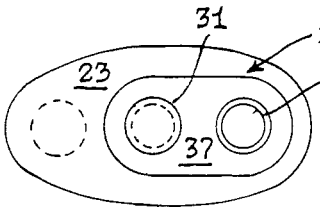
FIG. 10.
FIG. 11.
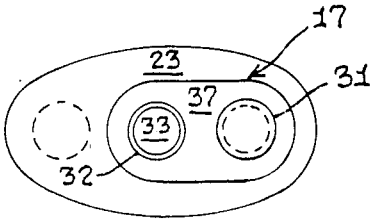
FIG. 13.
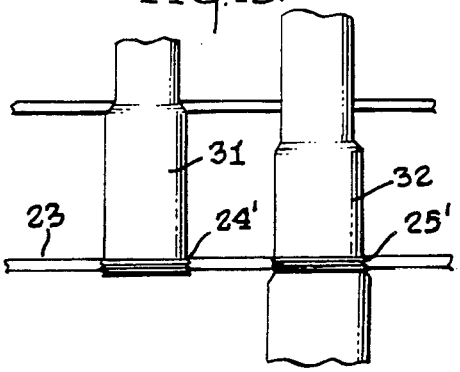
FIG. 14.
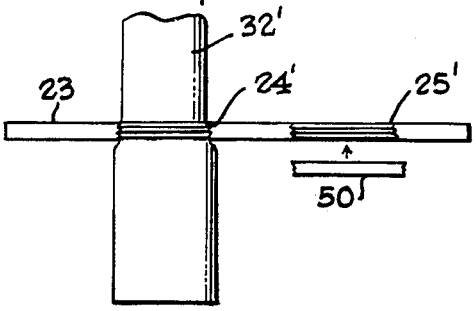

UNIVERSAL MUFFLER CONSTRUCTION ASSEMBLY

TECHNICAL FIELD

The present invention relates generally to reverse flow multi-tube muffler construction and variations thereof.

BACKGROUND OF THE INVENTION

The prior art is replete with myriad muffler constructions as is evidenced by U.S. Pat. Nos. 2,382,159; 3,145,800; 3,545,566; and 3,042,138.

Most modern muffler constructions vary somewhat from the structures contained in the above enumerated prior art devices, in that they normally employ a multi-tube reverse flow baffle arrangement. In addition, the typical oval muffler constructions found in today's marketplace usually only differ from one another and from one year's model to the next year's model, in the arrangement and relative disposition of the inlet and outlet tubes, with respect to the locator plate and end plate constructions on either end of the muffler.

An example of a typical offset/center multi-tube muffler construction is shown in cross-section in the drawings and labeled "prior art". In this construction a plurality of exhaust tubes are supported in mounting plates within the muffler housing. The exhaust tubes normally comprise an exhaust inlet tube, an exhaust outlet tube, and, a reverse flow tube. In addition, the outlet end of the muffler housing is normally provided with a baffle plate element containing a short baffle tube. The present invention evolved when it was recognized that, by varying the relative position of the aforementioned basic structural components in the prior art construction, different internal flow path configuration could be created from a single basic structural arrangement wherein the components could be mixed and matched to produce myriad muffler configurations.

BRIEF SUMMARY OF THE INVENTION

The present invention comprises a basic muffler construction, wherein the individual components may be selectively disposed and oriented with respect to one another to provide a universal muffler arrangement having a number of different internal flow paths, as well as different inlet and exhaust orientations.

The present invention comprises in general a housing unit, a support unit, end plate units, one or more locator plate units, and an array of tubular elements. All of the aforementioned structural elements are interchangeable with like structural components as well as being orientable in diverse positions with respect to like and dis-like structural components.

Basically, the present invention represents a muffler construction wherein the user or manufacturer has the option to produce a variety of muffler configurations from the same basic components.

BRIEF DESCRIPTION OF THE DRAWINGS

These and other objects, advantages and novel features of the instnat invention will become apparent from the detailed description of the best mode for carrying out the invention which follows, particularly when considered in conjunction with the accompanying drawings, wherein:

FIG. 1 is a cross-sectional view of a typical multi-tube reverse flow prior art muffler construction;

FIG. 2 is an exploded perspective view of one form of the invention;

FIG. 3 is a cross-sectional view of one of the center pipe versions of the invention;

FIG. 4 is a cross-sectional view of one of the off-set pipe versions of the invention;

FIG. 5 is a cross-sectional view of a modified form of pipe version of the invention;

FIG. 6 is a top view of the two hole locator plate of the invention;

FIG. 7 is a side view of the two hole locator plate of the invention;

FIG. 8 is a top view of the two hole end plate of this invention;

FIG. 9 is a side view of the two hole end plate of this invention;

FIG. 10 is an end view of the off-set pipe version of this invention;

FIG. 11 is an end view of the center pipe version of this invention;

FIG. 12 is a cross-sectional view of the basic internal configuration of the improved muffler construction;

FIG. 13 is a detailed cross-sectional view of one exhaust arrangement made possible by a threaded version of the two hole end plate of this invention; and FIG. 14 is a detailed cross-sectional view of one inlet arrangement made possible by the threaded version of the two hole end plate depicted in FIG. 13.

BEST MODE FOR CARRYING OUT THE INVENTION

As mentioned earlier in the specification, a typical multi-tube muffler construction is depicted in FIG. 1 and labeled "Prior Art". This representative constsruction shares many of the basic structural components of the present invention and comprises a muffler housing member (1), housing end plate members (2), an exhaust tube array (3), exhaust tube support panels (4), and a baffle plate element (5). The exhaust tube array (3) comprises an exhaust inlet tube (6); an exhaust outlet tube (7) and, an exhaust reverse flow tube (8). The baffle plate element (5) is also normally provided with a short length of exhaust recycling tubing (9), and the flow of exhaust gases through the typical muffler construction is indicated by arrows.

The muffler construction of the present invention is designated generally by the reference numeral (10) and comprises a muffler housing member (11), housing end plate members (12), a primary exhaust tube array (13), exhaust tube support panels (14), a baffle locator plate element (15), an auxiliary exhaust tubing array (16) and auxiliary end plate elements (17).

As can best be seen by reference to FIG. 12, the muffler housing member (11) and the exhaust tube support panels (14) of the improved muffler construction (10) are virtually identical to the comparable prior art structural components. The muffler housing member (11) comprises an elongated cylindrical housing element (18), having an oval cross-section and, the exhaust tube support panels (14) have a similar oval configuration and are provided with a plurality of apertures (19) dimensioned to receive and support the primary exhaust tube array (13).

In the preferred embodiment depicted in FIG. 12, the exhaust tube array (13) comprises at least three similar exhaust tube sections (20, 21 and 22) which can interchangeably function as an exhaust tube inlet section (I), an exhaust tube outlet section (0), and an exhaust reverse flow section (R).

The housing end plate members (12) comprise end cap elements (23) that are dimensioned to engage the ends of the muffler housing member (11), and each of the cap elements (23) is provided with a central aperture (24) and an off-set aperture (25). As shown in the drawings, the central aperture (24) is dimensioned and disposed so that it will be aligned with exhaust tube (21), and the off-set aperture (25) is dimensioned and disposed so that it may be aligned either with exhaust tube (20) or exhaust tube (22).

The exhaust tube support panels (14) comprise standard apertured support panel elements (26) that extend across the interior of the muffler housing member (11), and which are designed to suspend and support the primary exhaust tube array (13) in a well recognized manner.

The baffle locator plate element (15) comprises a plate member (27) that is dimensioned to conform to the interior of the muffler housing (11); and, which is further provided with a central aperture (28) and a pair of off-set apertures (29, 29'). As shown in the drawings, the apertures (29 and 29') are dimensioned and disposed so that they are aligned with the exhaust tubes (20, 21 and 22).

The auxiliary exhaust tubing array (16) is best depicted in FIG. 2 and comprises a baffle tube (30), a blind exhaust tube (31), and an elongated exhaust transmittal tube (32).

The baffle tube (30) comprises a short length of open tubing (33) that is operatively associated with the baffle locator plate member (27); and, as shown in phantom in FIG. 12, may be formed integrally with the plate member (27), in accordance with the teachings of the invention.

The blind exhaust tube (31) comprises a medium length of tubing (34), that extends between and is operatively associated with both the baffle locator plate member (27) and the exhaust end cap element (23). The blind exhaust tube (31) has a closed end (34) that may either be formed integrally with the exhaust tube (31) or may be sealed by cooperation with the auxiliary end plate elements (17), as will be explained further on in the specification.

The elongated exhaust transmittal tube (32) comprises an elongated length of open ended tubing (35), that is operatively associated with both the baffle locator plate member (27), the exhaust end cap element (23), and one of the exhaust tubes (20, 21, 22) in the primary exhaust tube array (13). In addition, the exhaust transmittal tube (32) is further provided with a reduced neck portion (36) that is dimensioned to be slidingly received within any one of the primary exhaust tubes (20, 21 and 22).

As can best be seen by reference to FIGS. 3 and 4, the relative position of the baffle locator plate member (27), the exhaust end cap element (23) and the auxiliary exhaust tubing array can be varied with respect to the muffler housing member (11) and the primary exhaust tube array (13). In FIG. 3, the exhaust transmittal tube (32) is centrally disposed with respect to the end cap member (23); and in FIG. 4, the exhaust transmittal tube (32) is off-set with respect to the end cap member. It should also be noted at this juncture that the arrangement depicted in FIG. 4 can be rotated 180° so that the exhaust transmittal tube would be off-set on the left hand side of the end cap member, as opposed to the right hand side.

As mentioned earlier in the specification, the blind exhaust tube (31) may be fabricated with a closed end (34); or, it may cooperate with the auxiliary end plate element (17) to achieve the same purpose and function. In one embodiment depicted in FIGS. 6 and 7, the auxiliary end plate element (17) comprises an elongated plate element (37) having a single aperture (38) formed therein. The elongated plate element is further dimensioned to sealingly engage one of the apertures (24, 25) in the end cap element (23), when the aperture (38) in the plate element (37) is aligned with the other aperture in the end cap element.

In another embodiment of the auxiliary end plate element (37) depicted in FIGS. 8 and 9, the blind exhaust tube (31) and the exhaust transmittal tube (32) are formed integrally with the auxiliary end plate element (17). In this version, the bottom of the blind exhaust tube (31) is formed by the surface of the auxiliary end plate element (37), and the aperture (38) forms part of the opening of the exhaust transmittal tube (32).

As can be seen by reference to FIGS. 10 and 11, the auxiliary end plate element (17) can be oriented with respect to the end cap member (23) to produce an off-set exhaust pipe arrangement, or a central exhaust pipe arrangement. In addition, the cap member (23) can be rotated 180° with respect to the muffler housing unit (11) to produce either a right hand or left hand exhaust pipe off-set.

It should be appreciated at this juncture that the housing end plate members (12), the baffle locator plate element (15), the auxiliary exhaust tubing array (16) and the auxiliary end plate elements (17) may all be disposed in different orientations with respect to one another, and to the basic muffler components, (i.e., the housing member (11), the primary exhaust tube array (13) and the exhaust tube support panels (14)) to produce different muffler configuration.

In the alternate embodiment illustrated In FIG. 5, the baffle locator plate element (15) has been dispensed with, as have the blind exhaust tube (31) and the reverse flow exhaust tube (30). The remaining structure comprises the basic muffler components (11, 13, and 14) and the exhaust transmittal tube (32) extending through the end cap member (23) and the auxiliary end plate element (17).

It should also be noted that heretofore the invention has only been described with respect to the outlet end of the muffler apparatus (10). It should be fairly obvious at this point that this invention also encompasses, and intends for, the identical cooperation to take place at the inlet end of the muffler; whereby the inlet end cap member (23) is provided with apertures (24 and 25) and an auxiliary end plate element (17) that will sealingly engage one of the apertures, and an exhaust inlet transmittal tube (32).

The aforementioned arrangement would be structurally identical to that depicted in FIG. 5; however, the flow of exhaust gases as indicated by the arrows in the exhaust inlet transmittal tube (32) would be reversed, as would the letter designations of the primary exhaust tube array.

In the embodiments depicted in FIGS. 13 and 14, the housing end cap elements (23) are both interchangeable and reversible, and, provided with a central threaded aperture (24') and a threaded off-set aperture (25'). FIG. 13 depicts one of many possible exhaust arrangements wherein the exhaust transmittal tube (32) and the blind exhaust tube (31) are provided with threaded portions on their respective peripheries that will cooperate with either of the threaded central and off-set apertures (24') or (25') on the end cap element (23).

FIG. 14 depicts one of many possible inlet arrangements wherein an exhaust inlet transmittal tube (32') has a narrow end adapted to be received in any one of the primary exhaust tubes (20), (21), (22) and an intermediate threaded portion that will cooperate with either of the threaded central and off-set apertures (24'), (25') on the end cap element (23). In addition, a threaded plug member (50) is provided so that either of the threaded apertures (24') or (25') may be effectively sealed depending on the chosen location of the exhuast inlet transmittal tube (32').

It should be appreciated by now that the mix and match components heretofore described define a universal muffler construction assembly wherein myriad internal and external muffler configurations may be constructed and assembled from a minimum number of components thereby reducing inventories, yet maintaining the ability to give the customer any one of a number of diverse muffler constructions.

Having thereby described the subject matter of this invention, it should be obvious that many substitutions, modifications and variations of the present invention are possible in light of the above teachings. It is therefore to be understood that the invention as taught and described herein is only to be limited to the extent of the breadth and scope of the appended claims.

I claim:

1. A universal muffler construction wherein the basic muffler components may be assembled in a variety of structural relationships to produce different internal and external muffler configurations wherein the basic components comprise a generally cylindrical muffler housing member, a primary exhaust tube array comprising an exhaust inlet tube, an exhaust outlet tube and a reverse flow tube, supported within the housing member by exhaust tube support panels, and wherein the improvement comprises:

a pair of end cap elements provided with a central aperture and an offset aperture wherein the end cap elements are adapted to assume different orientations with respect to the ends of the said muffler housing member; and an auxiliary exhaust tubing array comprising an exhaust transmittal tube adapted to be received in one of the said apertures in the end cap element, and operatively connected to the exhaust outlet tube in the said primary exhaust tube array.

2. A universal muffler construction as in claim 1; further comprising:

auxiliary end plate elements adapted to cooperate with the end cap elements to sealingly engage one of the apertures in said end cap elements.

3. A universal muffler construction as in claim 2; further comprising:

a baffle locator plate adapted to be received in the said muffler housing member and disposed intermediate one of the end cap elements and one of the exhaust tube support panels, wherein the baffle locator plate is provided with a central aperture and two offset apertures.

4. A universal muffler construction as in claim 3; wherein said auxiliary exhaust tubing array further comprises:

a blind exhaust tube; and, a baffle tube.

5. A universal muffler construction as in claim 4; wherein:

the apertures in the said baffle locator plate are adapted to receive the said exhaust transmittal tube, the blind exhaust tube, and the baffle tube.

6. A universal muffler construction as in claim 5; wherein:

the relative position of the blind exhaust tube, the baffle tube and the exhaust transmittal tube may be varied with respect to the said baffle locator plate apertures, and the said primary exhaust tube array to create different internal muffler flow path configurations.

* * * * *